US011633068B2

(12) United States Patent
Trotter

(10) Patent No.: US 11,633,068 B2
(45) Date of Patent: Apr. 25, 2023

(54) INFANT BATHING APPARATUS

(71) Applicant: Kourtney Michaela Trotter, Gary, IN (US)

(72) Inventor: Kourtney Michaela Trotter, Gary, IN (US)

( * ) Notice: Subject to any disclaimer, the term of this patent is extended or adjusted under 35 U.S.C. 154(b) by 0 days.

(21) Appl. No.: 17/526,652

(22) Filed: Nov. 15, 2021

(65) Prior Publication Data

US 2022/0151440 A1 May 19, 2022

Related U.S. Application Data

(60) Provisional application No. 63/113,990, filed on Nov. 16, 2020.

(51) Int. Cl.

| | |
|---|---|
| ***A47K 3/034*** | (2006.01) |
| ***A47K 3/024*** | (2006.01) |
| ***A47K 3/12*** | (2006.01) |

(52) U.S. Cl.

CPC ..... *A47K 3/034* (2013.01); *A47K 3/024* (2013.01); *A47K 3/127* (2013.01)

(58) Field of Classification Search

CPC ..... A47K 3/034; A47K 3/024; A47K 3/127
USPC ..... 4/572.1, 565.1, 579, 586, 587, 659
See application file for complete search history.

(56) References Cited

U.S. PATENT DOCUMENTS

| | | | | |
|---|---|---|---|---|
| 2,902,699 | A | 9/1959 | Miller | |
| 5,809,588 | A | 9/1998 | Angelotti | |
| 6,276,979 | B1 * | 8/2001 | Saltel | B63B 34/50 441/132 |
| 6,485,344 | B2 * | 11/2002 | Arias | B63C 9/081 441/131 |
| 9,867,479 | B2 | 1/2018 | Kaplan | |
| 10,568,465 | B2 | 2/2020 | Fusco et al. | |
| 2005/0000014 | A1 | 1/2005 | Miller et al. | |
| 2008/0155743 | A1 | 7/2008 | Allen | |
| 2011/0107511 | A1 | 5/2011 | Alcala et al. | |
| 2014/0345042 | A1 | 11/2014 | Morand | |
| 2018/0177347 | A1 | 6/2018 | Batiste | |

FOREIGN PATENT DOCUMENTS

| | | |
|---|---|---|
| GB | 2196247 A | 4/1988 |
| GB | 2386321 A | 9/2003 |

* cited by examiner

*Primary Examiner* — Tuan N Nguyen
(74) *Attorney, Agent, or Firm* — Bold IP, PLLC; Binita Singh

(57) ABSTRACT

One or more embodiments are disclosed for an infant bathing apparatus that fits in any sized bathtub for bathing a newborn, an infant, or a toddler and further allows a parent to sit in the bathtub during bath time. The infant bathing apparatus comprises a frame, a sling, one or more straps, and a stand. The frame is rigid and made of a buoyant material to stay afloat on top of the water and further defines an opening within which the sling is placed and removably connected to the frame. The sling holds and supports the baby within the frame. The one or more straps connect to the frame and may have suction cups that secure the frame to the sides of the bathtub. The stand is connected to the frame and rests on the floor of the bathtub. A parent may sit comfortably within the bathtub either with the stand attached to the frame or remove the stand from the frame once sitting inside the bathtub.

22 Claims, 10 Drawing Sheets

INFANT BATHING APPARATUS

CROSS-REFERENCE TO RELATED APPLICATION

This application is a non-provisional application which claims priority to U.S. Provisional Patent Application No. 63/113,990 filed on Nov. 16, 2020, which is incorporated by reference in its entirety.

FIELD OF DISCLOSURE

The present invention relates to an infant bathing apparatus. In particular, the apparatus herein generally pertains to a co-bathing apparatus adapted to be mounted to a bathtub and hold an infant within the apparatus and allow a parent to co-bath. The apparatus described herein also generally pertains to an apparatus that can be used independently of a bathtub for general use as an infant holder.

BACKGROUND

There are so many ways to bond with a baby. Bathing a baby is one of those moments where a parent and baby can experience a bonding moment. However, most often bathing a baby can be stressful because it may be challenging to hold a tiny, slippery, and wiggling baby while trying to bathe her at the same time. Even bending over a bathtub or a sink can be uncomfortable and takes away from a relaxing and stress-free bonding moment. Parents often bathe their babies in sinks, buckets, or specially designed smaller tubs for infants because regular bathtubs are dangerous and can lead to drowning. However, regular bathtubs are not the only culprits in drownings, as drowning is still very possible in a bucket or a smaller tub without proper supervision.

Taking a bath with the baby would allow for a deeper connection and a better way to bond together. Co-bathing with a baby is very beneficial for both the baby and the parent. Among others, it provides a benefit of skin-to-skin contact with the baby. Co-bathing has also been shown to be very beneficial to breastfeeding mothers because the relaxing environment along with the skin-to-skin contact increases milk let down. However, there are fears about safely bathing with a baby.

Accordingly, several ideas have been implemented to solve the above problem of safely bathing a baby. Some ideas promote a safe way of bathing together with the baby. Some other ideas disclose devices that allow a baby to be placed safely in the bathtub where the baby is seated. However, none of the ideas disclose a device that allows a parent to comfortably sit in the bathtub with the baby to bathe together while the baby is in a prone position.

Thus, there is still a need for an improved co-bathing apparatus that is safe for an infant and further allows a parent and infant to bathe together.

SUMMARY

One or more embodiments are provided below for an infant bathing apparatus adapted to be securely positioned within a bathtub of varying sizes. The infant bathing apparatus is intended to be used for newborns, infants, and toddlers which may be collectively referred to as a "baby." The infant bathing apparatus may be secured within a bathtub and immobilized allowing a baby to be bathed while laying semi-prone within the infant bathing apparatus, wherein the baby's head rests above the torso. The infant bathing apparatus is configured such that a parent may enter the bathtub, sit comfortably in front of the infant bathing apparatus with a baby nestled within facing the parent and allowing the parent and the baby to bathe and bond together.

In the one or more non-limiting embodiments provided below, the infant bathing apparatus is comprised of a frame, a sling, one or more straps, and a stand. The frame may be considered as the center piece to which all the other components are connected to. The sling is placed within the frame and connected to the frame. The sling is intended to support a weight of an infant or a toddler. The one or more straps may comprise of suction cups and once the one or more straps are connected to the frame, the suction cups secure the frame to an inside of a bathtub by attaching to a side or sides of the bathtub. The stand may comprise of one or more legs which connect to the frame. With the stand, the infant bathing apparatus may be placed within a bathtub and allow an infant or toddler to be placed on the sling. A parent may sit comfortably within the bathtub with the infant or toddler in the infant bathing apparatus. The parent may either sit with the stand attached or remove the stand once sitting inside and the infant bathing apparatus is secured to the bathtub with the suction cups on the one or more straps.

It is an object of the present invention to provide an improved and safe infant bathing apparatus to place a baby for bathing in a bathtub.

It is also an object of the present invention to provide a co-bathing apparatus that allows a baby to be in a semi-prone position.

It is still another object of the present invention to provide a co-bathing apparatus that can be secured within varying sizes of bathtubs.

It is yet another object of the present invention to allow a parent to fit inside the bathtub with a baby placed in the apparatus and provide a more comfortable and safe means to bathe with the infant or the toddler.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
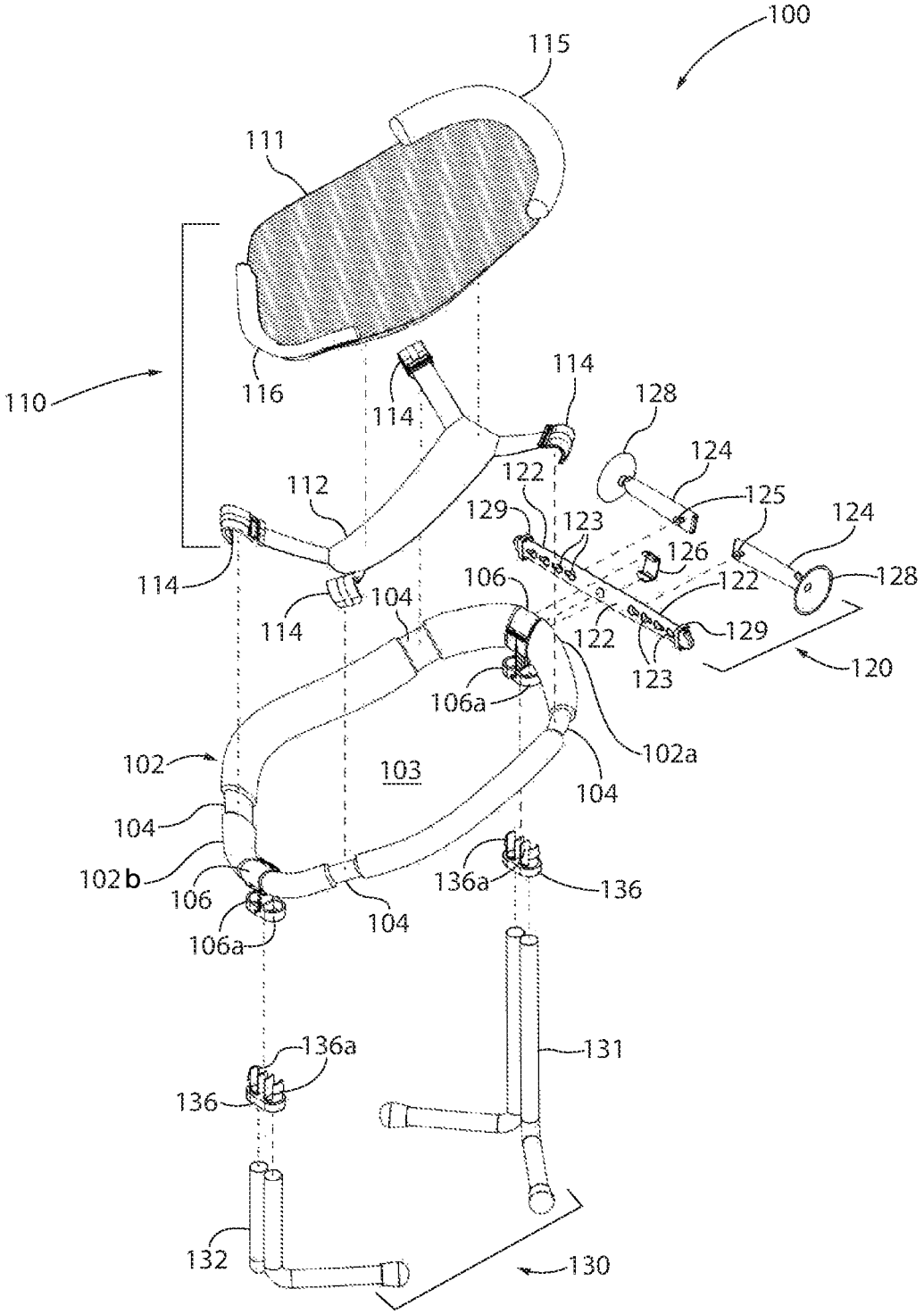
FIG. 1 is a pictorial illustration of an expanded view of an infant bathing apparatus.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "coupled to" as used herein may mean a direct or indirect connection via one or more components.

The present disclosure is generally drawn to various embodiments for an infant bathing apparatus. Sharing bath time together with one's baby has many benefits. Notably, it is a great way for a nursing mom to have a more peaceful breastfeed as the interaction and the contact with the infant boosts the milk making hormones. Additionally, it allows a good time to relax with the baby and offers an opportunity to deepen the bond between mom and baby. In yet another benefit, co-bathing with an infant helps the baby feel safe and secure. Bath time in general is also beneficial for an infant or toddler. It encourages language development and stimulates their senses. Listening to a parent talk during a bath about what they are seeing, feeling, smelling, and hearing helps the infant or toddler learn and grow.

In one or more non-limiting embodiments, the present description provides embodiments for an infant bathing apparatus that makes it possible to bathe safely and securely a newborn, an infant, or a toddler (collectively referred to as "baby" for remainder of the description). In particular, the one or more non-limiting embodiments for the infant bathing apparatus enables the apparatus to be used in any existing bathtub or any that may be designed in the future because the infant bathing apparatus is sized to adjustably fit within and securely attach to a bathtub. Accordingly, a parent can place the infant bathing apparatus in a bathtub and, using the method described herein, make the infant bathing process more secure, safe, and enjoyable and further allow a parent and baby to bond. This is advantageous as most devices do not allow all the benefits of bonding with a baby in a stress free and relaxing moment during a bath. The ability to allow a parent to sit unhindered in the bathtub with the baby in the infant bathing apparatus enhances the bathing experience for the parent and the baby and improves the bond.

Accordingly, the one or more non-limiting embodiments provided below describe an infant bathing apparatus and method of setting up the infant bathing apparatus in the various types of bathtubs and bathtub sizes configured to contain water. The embodiments provided herein may be used for bathing an infant alone in the bathtub under parent supervision and may also be used with the parent sitting unhindered in the bathtub with the baby in the infant bathing apparatus. Further details are provided below with reference to the Figures.

Referring particularly to the Figures in the accompanying drawings, there is illustrated a non-limiting embodiment of an infant bathing apparatus 100. FIGS. 1 through 6 illustrate the infant bathing apparatus 100 that may be secured within a bathtub to provide a stable platform for bathing a baby. FIG. 1 is an expanded view of the infant bathing apparatus 100. FIGS. 2 to 6 illustrate perspective views of the infant bathing apparatus 100 from a front, a side, a back, a top, and a bottom, respectively. The infant bathing apparatus 100 generally comprises of a frame 102, a sling 110, one or more straps 120, and a stand 130. The frame 102 can fit within a bathtub (e.g., bathtub 500 in FIG. 7). The sling 110 is placed within and securely connected to the frame 102. The sling 110 is adapted to hold a baby within the frame 102. The one or more straps 120 are connected to the frame 102 and may secure the infant bathing apparatus 100 to an inside of a bathtub by attaching to a side or sides of the bathtub (see, bathtub 500 in FIG. 7). The stand 130 may connect to the frame 102 and may be adapted to rest on a flat surface, such as a floor of the bathtub. The infant bathing apparatus 100 may be placed in a bathtub secured with the stand 130 and the one or more straps 120 and an infant or toddler may be placed on the sling 110 and kept safe and secure during a bath. The infant bathing apparatus 100 is designed such that a parent may sit unhindered in the bathtub with the baby in the bathing apparatus 100.

Figure 5:
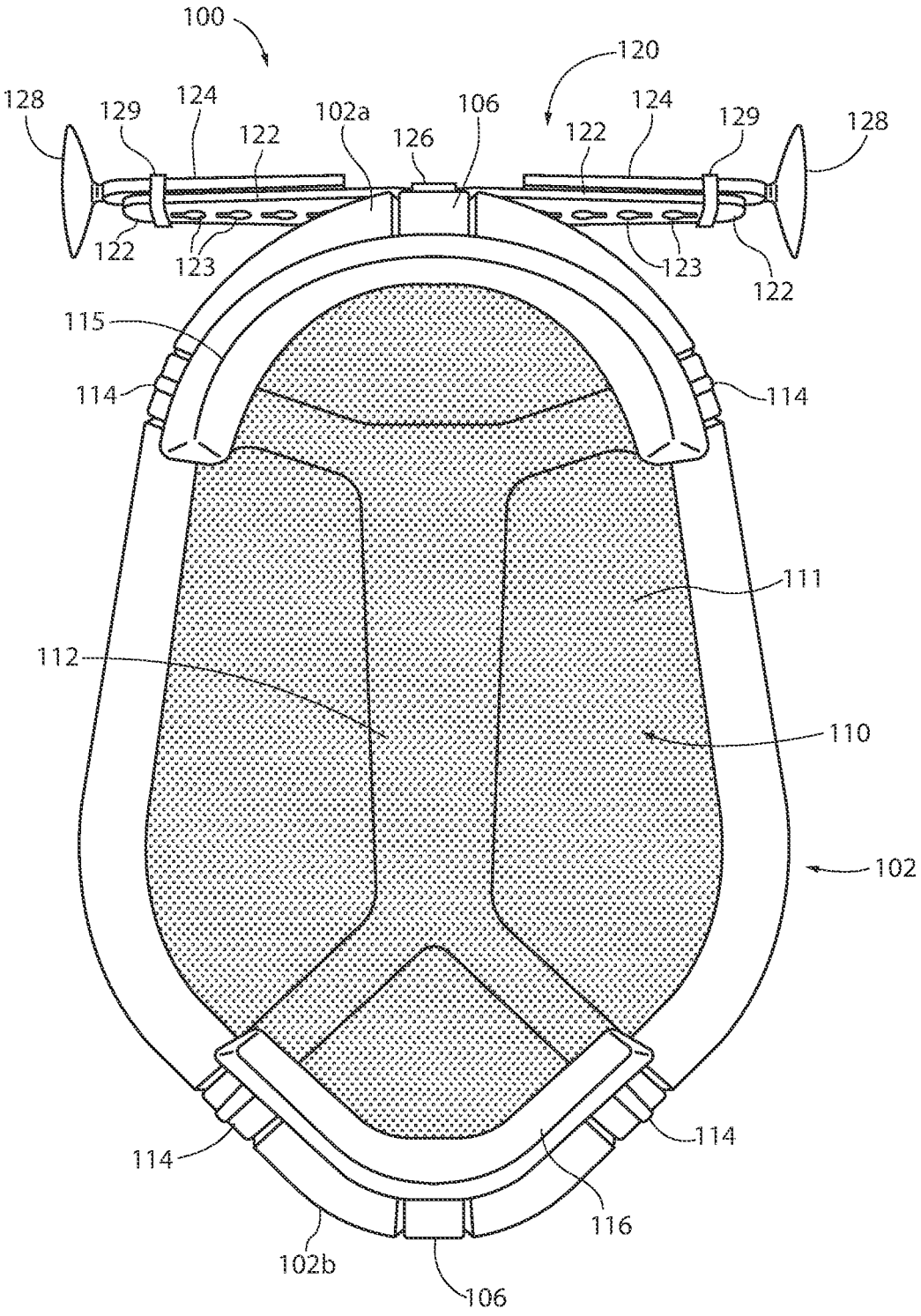
FIG. 5 is a pictorial illustration of a top perspective view of an infant bathing apparatus.
Figure 6:
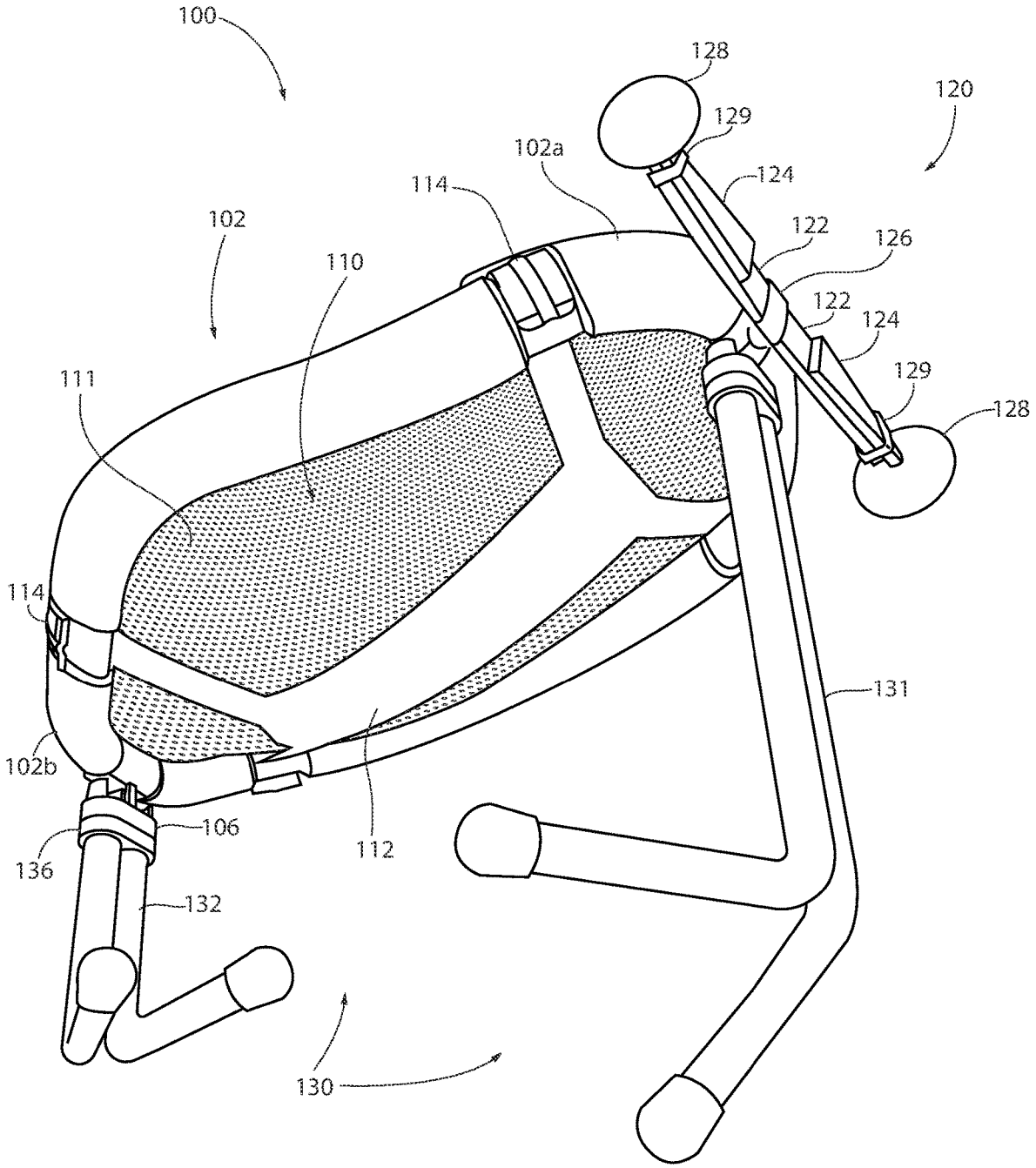
FIG. 6 is a pictorial illustration of a bottom perspective view of an infant bathing apparatus.
Figure 7:
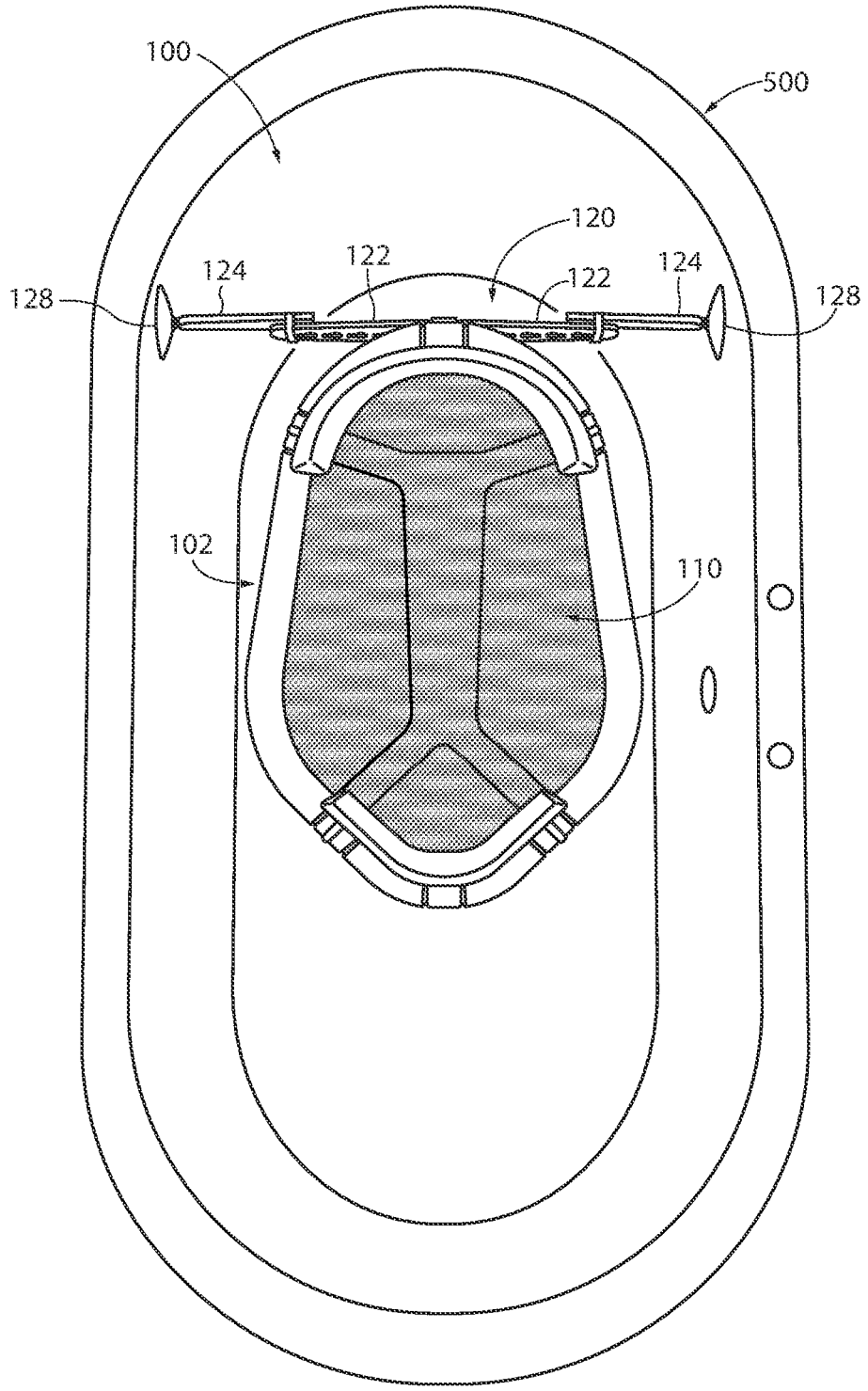
FIG. 7 is a pictorial illustration of a top view of an infant bathing apparatus placed within a bathtub.

The frame 102 is a rigid structure providing an overall structure to the infant bathing apparatus 100. As best seen in FIG. 1, the frame 102 is generally oval shaped and defines an opening, referred to as a frame opening 103. The frame opening 103 is designed to receive and be covered by the sling 110. It is to be understood that in other non-limiting embodiments, the frame 102 may have alternate shapes including and not limited to a square, a rectangle, and a circle. Essentially, any appropriate shape of the frame 102 is considered. The frame 102 has a head end 102*a* and foot end 102*b*, which may correspond with the way a baby may be positioned in the infant bathing apparatus 100. As best seen in FIG. 5 and FIG. 7, the head end 102*a* may be relatively narrower than the foot end 102*b* allowing more room for a baby placed within the infant bathing apparatus 100 to kick and flail their legs within the frame 102 without hitting the frame 102. It is to be understood that the frame 102 may have equally sized head end 102*a* and foot end 102*b*, or the foot end 102*b* may be narrower than the head end 102*a*.

The frame 102 is shown to have an overall smooth surface with rounded edges to increase safety and comfort and generally prevent a baby from getting hurt while placed in the sling 110. For instance, a baby placed in the sling 110 covering the frame opening 103 will generally encounter smooth rounded edges on the frame 102 that avoids hurting the baby's extremities while the baby is moving and swinging the extremities. The frame 102 may have any appropriate cross-sectional shape including and not limited to a circle, an oval, a square, a rectangle, or a polygon as long as the frame 102 maintains the smooth surface and the rounded edges.

The frame 102 may be a one-piece molded unit made of material having a suitable structural stability. According to one non-limiting preferred embodiment, the frame 102 may be made of a buoyant material such that the frame 102 is able to stay afloat over the water in a bathtub. In the preferred non-limiting preferred embodiment, the frame 102 may be used without the stand once the frame is secured to a bathtub with the one or more straps as the buoyant nature of the frame 102 will prevent the frame 102 from sinking even when a baby is placed within the sling 110 connected to the frame 102. It is advantageous to have a frame 102 that can float above the water as this allows more flexibility for a parent to sit completely unhindered in the bathtub with the baby. The materials for the frame 102 are chosen as a function of the contemplated use, namely repeated exposure of the frame 102 to bathing water and maintaining buoyancy with a baby in the infant bathing apparatus 100. Such materials may include and not be limited to foam (e.g., cross-linked polyethylene foam) and any other suitable material having structural integrity and buoyancy.

Moreover, alternative embodiments contemplate the frame 102 to be made from alternative materials that can withstand repeated exposure to bathing water but are not buoyant. Thus, the alternative embodiments contemplated use would not be defined as maintaining buoyancy. In such a contemplated use, the stand 120 would be a necessary component as supporting the frame 102 in a bathtub reasonably above a water line.

The frame 102 may be arranged with one or more notch 104, which are defined as recessed areas on a surface of the frame 102. As best seen in FIG. 1, the frame is arranged with four notches 104. The one or more notches 104 have a width and may be arranged around an entire periphery of the frame 102. Alternatively, the one or more notches 104 may be arranged on an upward facing surface of the frame 102. The one or more notches 104 are provided such that the sling 110 having one or more clips 114 may be arranged between the frame opening 103 with the one or more clips 114 hooking onto the frame 102 in the one or more notches 104. As seen in FIGS. 1 to 6, the one or more clips 114 are shaped to matingly engage with the one or more notches 104 such that the one or more clips do not slide once engaged within the one or more notches. Accordingly, the combination of the one or more notches 104 and the one or more clips 114 allows the sling 110 to be hung in the frame opening 103 and be fully supported. Moreover, the arrangement allows for the sling 110 to be easily removed from the frame 102. As shown in the Figures, the one or more clips 114 is provided in equal number to the one or more notches 104. Thus, in the illustrated non-limiting embodiment, there are provided four clips 114 to compliment the four notches 104. The one or more notches 104 are arranged in the selected locations on the frame 102 to provide the sling 110 the adequate support to sustain the weight of a baby and remain hung.

The sling 110 defines a feature that will support a baby during the bathing activity. The sling 110 has a non-rigid flexible nature to conform to a baby's weight and provide an appropriate surface to lay the baby on for the bathing activity. As best seen in FIG. 1, the sling 110 has a body panel 111 and a support 112. The body panel 111 may be a hammock-like panel that is connected to the support 112. The support 112 is a strip of material strategically connected to the body panel 111 along a middle and having one or more branches extending out toward one or more edges of the body panel 111. As seen in FIGS. 1 to 6, the support 112 extends toward the one or more notches 104 when the sling 110 is on the frame 102. The support 112 that extends out toward the one or more notches 104 is integrated to the one or more clips 114. Thus, the support 112 integrated with the one or more clips 114 connected to the body panel 111 together comprise the sling 110. As seen in FIGS. 2 to 6, the overall arrangement of the sling 112 has the support 112 offering some flexible support and the means to connect the body panel 111 to the frame 102.

The material used for the body panel 111 of the sling 110 is selected for comfort and resiliency. Moreover, the material is also selected as to be subjected to the water in a bathtub. The body panel 111 may be comprised of a material that has a multiplicity of perforation through which water may readily circulate. The material may also be relatively flexible and conform to the shape of the baby, which not only offers comfort but also increases the stability between the baby and the sling 110. Examples of material that may be used include and are not limited to polymers, thermoplastic elastomers, urethane, silicone, and natural fabrics among numerous other possibilities. The flexible material with a multiplicity of perforations offers the advantage of allowing the water to flow through the numerous perforations. Additionally, such a material is easy to wash and dry once the bath time has finished. The same material used to make the body panel 111 may also be used to fashion the support 112. It is to be understood that an alternative material may be used to fashion the support 112 as long as the material chosen conforms with the contemplated use of the support 112. In the non-limiting embodiment shown in the Figures, the sling 110 is a removable feature of the infant bathing apparatus 100. Thus, the sling 110 may be removed by sliding the one or more clips 114 off the one or more notches 104 in the frame. The sling 110 may be rinsed and/or washed to remove any bath water and then dried.

Figure 2:
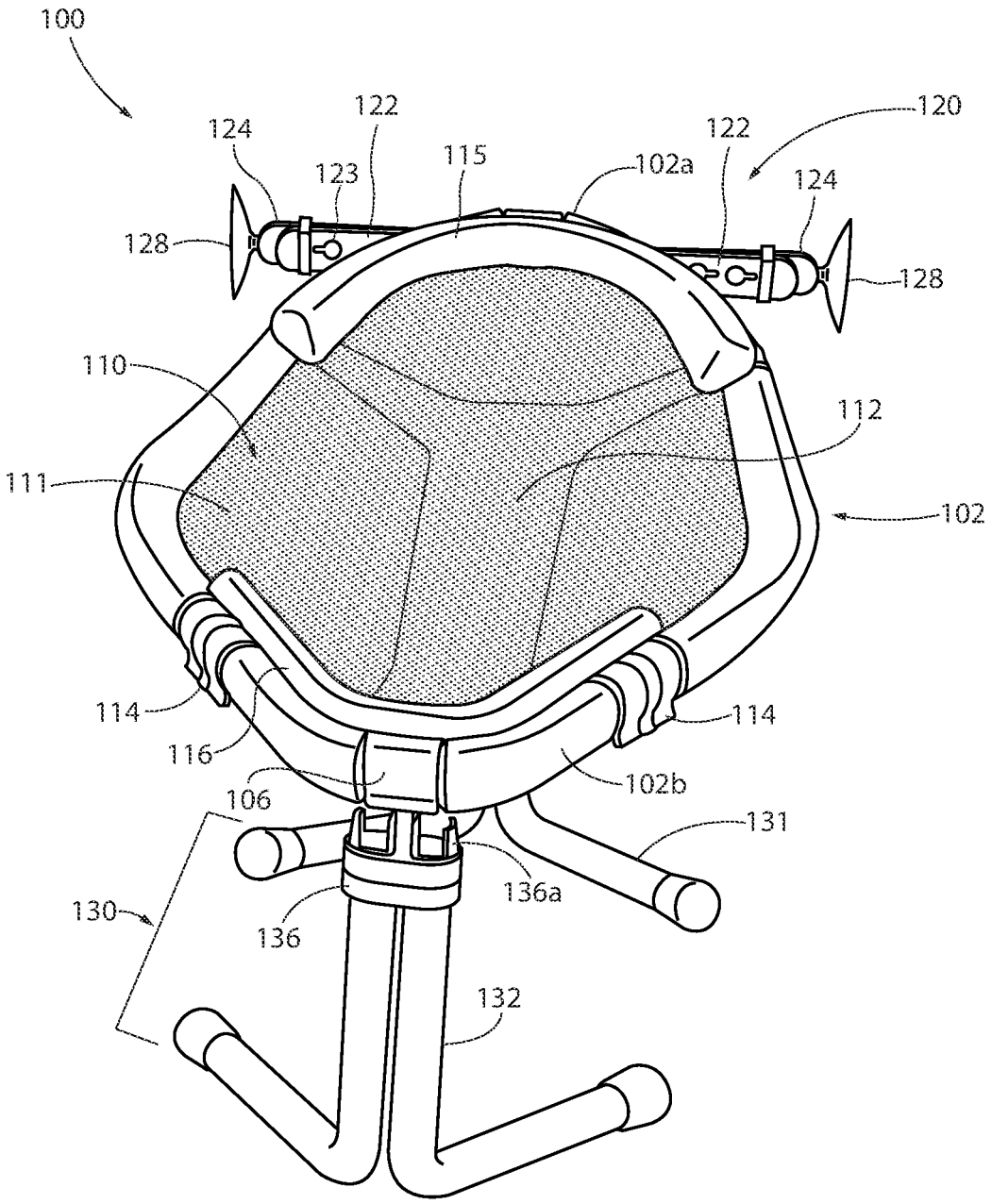
FIG. 2 is a pictorial illustration of a front perspective view of an infant bathing apparatus.
Figure 3:
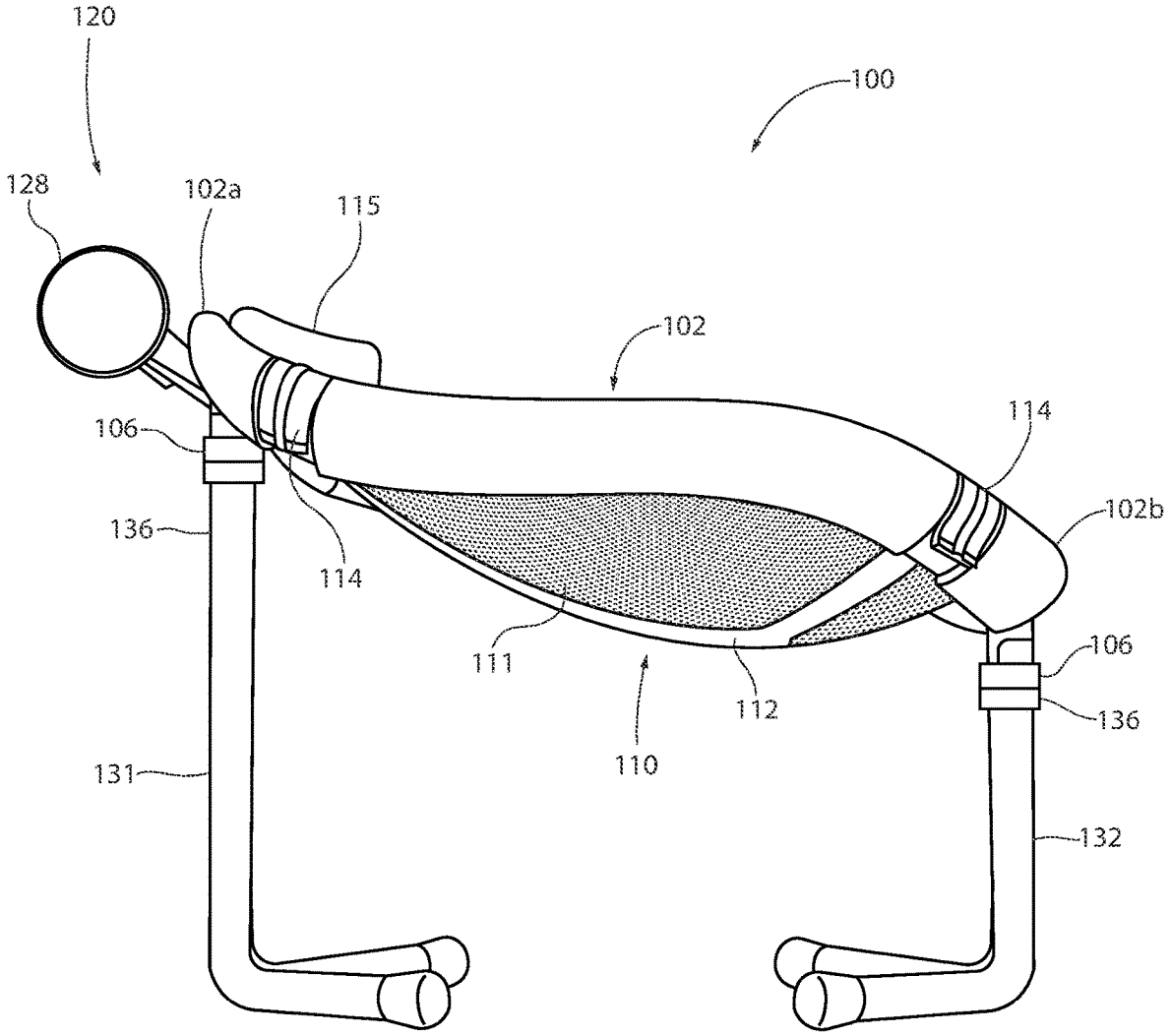
FIG. 3 is a pictorial illustration of a side perspective view of an infant bathing apparatus.
Figure 4:
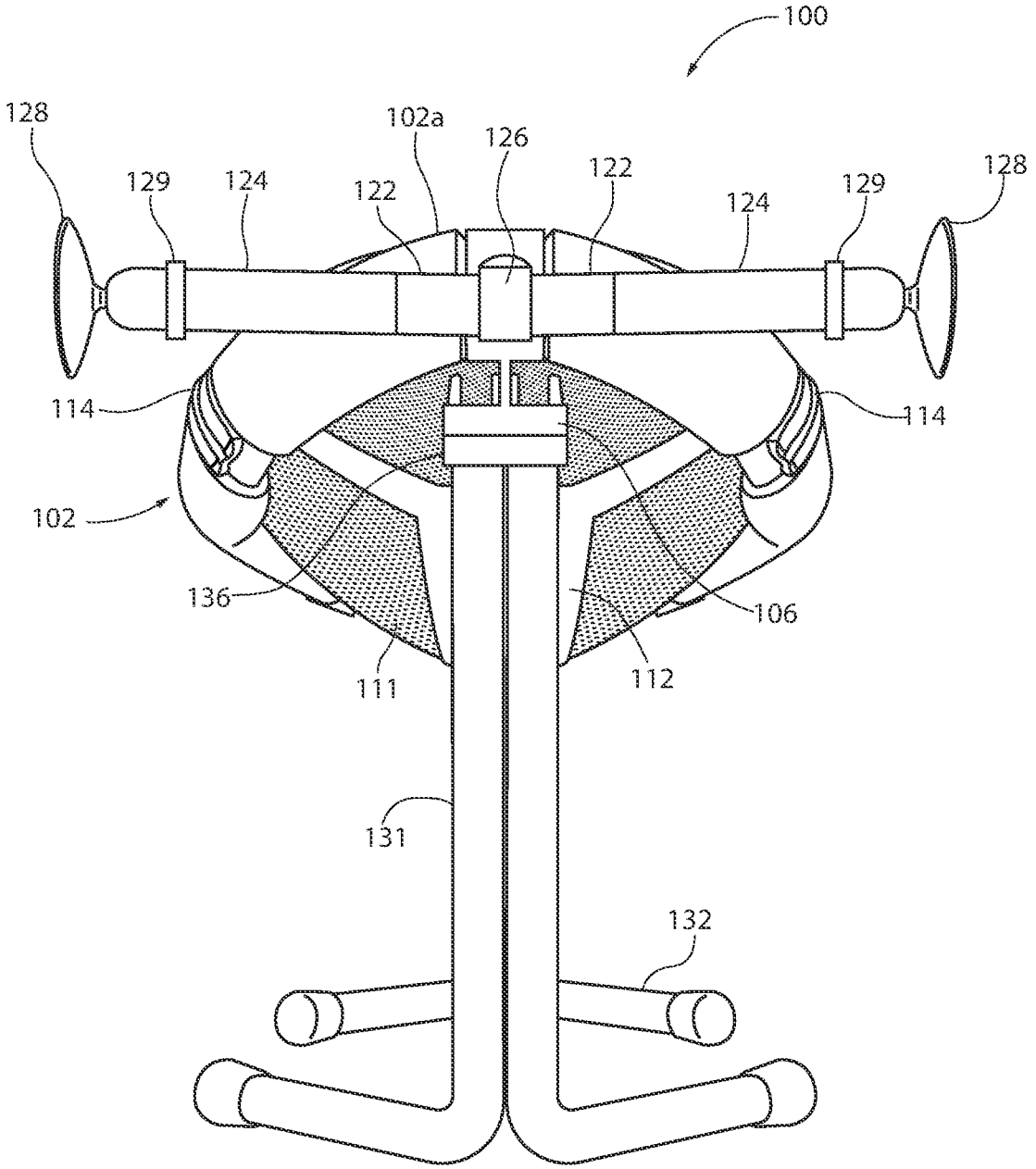
FIG. 4 is a pictorial illustration of a back perspective view of an infant bathing apparatus.

As seen in FIGS. 1, 2, and 5, the sling 110 also comprises of a head pad 115 and a foot pad 116. The head pad 115 and the foot pad 116 correspond with the head end 102*a* and the foot end 102*b* of the frame when the sling 110 is placed within the frame opening 103 and hung onto the frame 102. The material used to make the head pad 115 and the foot pad 116 may include material that is soft and padded, providing protection for a head and feet of a baby placed on the sling 110 and ensuring that the head and feet are comfortably supported. Such material may include a foam composite among others. The head pad 115 and the foot pad 116 may be integrated onto the body panel 111. Alternatively, the head pad 115 and the foot pad 116 may be removable features that are attached onto the body panel 111 when preparing for a bath. In the alternative embodiment, the head pad 115 and the foot pad 116 may be attached to the body panel 111 with any reasonable attachment means known in the arts including, and not limited to, snap buttons and VELCRO.

The frame 102 and the sling 110 are typically separate elements. However, it is contemplated that the frame 102 and the sling 110 may be merged and integrated together. In such a case, the sling 110 may not be removable and would be molded into the frame 102 during the manufacturing process making it a permanent fixture. It is also to be understood that the connection of the sling 110 to the frame 102 may have variants. For instance, the frame 102 may have one or more hooks integrated on the surface and the sling 110 may have one or more corresponding notches that slide over the one or more hooks to hang the sling 110 in the frame opening 103.

According to a non-limiting embodiment, the infant bathing apparatus 100 is configured with parts that are removable for washing after bathing and easy storing for future use. FIG. 1 illustrates the exploded view of the infant bathing apparatus 100 and how some parts may be connected to configure into the infant bathing apparatus 100. The stand 130 may be easily connected to the frame 102 and removed when needed. In the embodiments shown in the Figures, the stand 130 may comprise of one or more legs, wherein a first pair of legs 131 is connected to a head end 102*a* of the frame 102 and a second pair of legs 132 is connected to the foot end 102*b* of the frame 102. It is to be understood that only one leg may connect to the head end 102*a* and only one leg may connect to the foot head 102*b*. It is also to be understood that any reasonable combination of number of legs and leg configurations may connect to the head end 102*a* and the foot end 102*b*. The stand 130 offers stability to the overall infant bathing apparatus 100 and the use of legs and the number of legs is dependent on that functionality.

The one or more legs, such as the first and second pair of legs 131, 132, may be bent at a point where the one or more legs rest on a floor. As seen in FIGS. 1 to 6, the first and second pair of legs 131, 132, connect to the frame 102 and extend downward and at a point are bent to rest more stably on the floor. The bend on the first and second pair of legs 131, 132 creates more surface area of contact with the floor and thus creates more stability for the infant bathing apparatus when resting on the floor especially with a baby placed within the sling 110. Additionally, each leg in the first pair and second pair of legs 131, 132, is shown with the bent portion resting on the floor extending away from each other to create additional stability. It is to be understood, that the one or more legs may include straight legs and not be bent or may include a combination of straight legs and bent legs.

As shown, the first pair of legs are adjoined or touch each other as they extend downward from the frame 102. Similarly, the second pair of legs are adjoined together are adjoined or touch each other as they extend downward from the frame 102. At the bend in the first and second pair of legs 131, 132, the legs turn away from each other creating a wide angle at the bend. As discussed above, the turning away of each of the legs on the first and second pair of legs 131, 132 offers more stability to the overall structure of the infant bathing apparatus 100 when placed on the floor. It is also to be understood that each of the legs of the first and second pair of legs 131, 132, may connect to the frame 102 apart from each other. Furthermore, the pair of legs may be a single piece molded in a similar fashion as in the figures The frame 102 and the stand 130 may connect to each other by a snap joint assembly wherein the frame 102 may include one or more fixed clip assembly 106 and the stand 130 may include one or more snap hook assembly 136 that matingly connect to each other. As best seen in FIG. 1, the frame includes one fixed clip assembly 106 at the head end 102*a* and a second fixed clip assembly 106 at the foot end 102*b*. The stand 130 includes a first snap hook assembly 136 on the first pair of legs 131 and a second snap hook assembly 136 on the second pair of legs 132. In the non-limiting embodiment shown in the Figures, each of the fixed clip assembly 106 is designed with two openings 106*a*. Similarly, each of the snap hook assembly 136 is designed with two snap hooks 136*a* such that when the stand 130 is connected to the frame 102, the two openings 106*a* in the fixed clip assembly 106 matingly accepts the two snap hooks 136*a* on the snap hook assembly 136 to connect stand 130 to the frame 102. It is to be understood that each of the snap clip assembly 136 and the fixed clip assembly 106 may have one snap hook 136*a* and one opening 106*a*, respectively or any combination thereof. It is also to be understood that alternatives to a snap joint assembly as a form of attachment are also contemplated as part of this disclosure such as and not limited to a threaded assembly wherein the one or more legs may threadably engage with the frame to connect or a sliding assembly wherein the one or more legs may slide into a connection point to connect with the frame, among others. Alternatively, the stand 130 and the frame 102 may be manufactured as one piece, wherein the stand 130 is configured with the frame and is not a removable feature.

As can be seen, the overall arrangement of the infant bathing apparatus 100 has the frame 102 and the sling 110 in an inclined relation relative to the surface the infant bathing apparatus 100 is placed on. This ensures that the baby's head is generally above the torso. The inclined relation is achieved by having the stand 130 connected to the frame 102 at the head end 102*a* be taller than the stand 130 connected to the frame 102 at the foot end 102*b*. As clearly seen in the embodiment in FIG. 3, the first pair of legs 131 connected to the head end 102*a* of the frame is relatively taller than the second pair of legs 132 connected to the foot end 102*b* of the frame 102. In one or more embodiments, the stand 130 may have a telescoping feature. Not shown in the figures, but using the above-described embodiment, the first pair of legs 131 and the second pair of legs 132 may telescope to adjust a height of the infant bathing apparatus 100. The flexibility of having telescoping legs accommodates for variability in the depths of bathtubs and also allows a parent or guardian to fill the bathtub to their desired level and adjust the height of the infant bathing apparatus 100 such that a baby is partially submerged above the water line when placed in the infant bathing apparatus 100.

The infant bathing apparatus 100 also comprises of the one or more straps 120 that secure the apparatus in the bathtub. The one or more straps 120 are adjustable by being extendable and retractable to fit a range of bathtub widths. In the embodiment shown in the Figures, the infant bathing apparatus 100 is shown to comprise of one strap 120. As best seen in FIG. 1, the one strap 120 comprise of a stationary arm 122 and two adjustable arms 124. Each of the adjustable arms 124 ends in a suction cup 128 on an end that connects to the bathtub wall. The one strap 120 is connected to the fixed clip assembly 106 on the head end 102*a* of the frame 102. The stationary arm 122 may be centrally screwed to the fixed clip assembly 106 to secure it to the frame 102. Further, a cover 126 is placed over a portion where the stationary arm 122 is screwed to the fixed clip assembly 106. The cover 126 may be screwed into the fixed clip assembly 106 over the stationary arm 122. Other secure attachment means are contemplated to be a part of this disclosure.

The two adjustable arms 124 connect to the stationary arm 122, with an adjustable arm 124 connected on either side of the cover 126 with the suction cups 128 on each of the adjustable arms 124 facing away from each other. The adjustable arms 124 are parallelly connected to the stationary arms 122 on either side of the cover 126. The adjustable arms 124 and the stationary arm 122 may connect to each other in a lock and key type of assembly such that the adjustable arms 124 may be moved to extend or retract a width of the strap 120 to adjust to varying widths of bathtubs.

As best seen in FIG. 1, an example of a lock and key assembly is illustrated which may be used to extend or retract the strap 120. The stationary arm 122 has a plurality of keyholes 123 on either side of cover 126. The plurality of keyholes 123 are in line and equally spaced on each side of the cover 126. The two adjustable arms 124 each have a key-nob 125 that engage with the keyholes 123 on the stationary arm 122 allowing the two adjustable arms 124 to connect to the stationary arm 122 with the suction cups 128 facing away from each other to extend toward a bathtub wall when placed within a bathtub. FIG. 7 is a top perspective view of the infant bathing apparatus 100 placed within a bathtub 500. As shown, the two adjustable arms 124 extend away from the cover 126 and the fixed clip assembly 106 with the suction cups 128 on each adjustable arm 124 securely attaching to the bathtub walls. Referring to FIGS. 1 through 7, one or more bands 129 provide additional support to hold the two adjustable arms 124 against the stationary arm 122. The one or more bands 129 also ensure that as the adjustable arms 124 are disconnected from stationary arm 122 from removing the key nob 125 from the keyhole 123, respectively, the adjustable arms 124 do not fall away from the stationary arm 122.

The stationary arm 122 and the two adjustable arms 124 may be fashioned from any material that is strong, durable, and has some elastomeric quality. The materials may include and not be limited to rubber or rubber like material (e.g., silicone). It is desired that the stationary arm 122 and the adjustable arms 124 have some elastomeric quality so that the stationary arm 122 and the adjustable arms 124 can stretch to securely attach to the side walls of the bathtub and also accommodate the weight of the baby placed in the infant bathing apparatus 100. It is to be understood that the stationary arm 122 and the adjustable arms 124 may also be made of alternative materials that do not have elastomeric quality, such as and not limited to plastics. It is also to be understood that the stationary arm 122 may be made of non-elastomeric material and the adjustable arms 124 may be made of elastomeric material or vice versa. It is also to be understood that the one or more straps 120 may only comprise of one arm with suction cups on both ends (not shown), wherein the one arm may be centrally screwed to the fixed clip assembly 106 on the head end 102*a* of the frame 102. In this non-limiting alternative embodiment, the one arm may be made of an elastomeric material allowing the one arm to stretch in both directions and securely attach to the side walls of the bathtub with the suction cups.

In the example embodiments described above, the infant bathing apparatus 100 is shown to comprise of one or more straps 120 that connect at the head end 102*a* of the frame 102. It is to be understood that the one or more straps 120 may additionally be connected to the foot end 102*b* of the frame. It is also to be understood that the one or more straps 120 at the head end 102*a* of the frame 102 may include a third arm that extends toward a back wall of a bathtub.

To install the infant bathing apparatus 100 in a bathtub, all the removable parts are connected. In particular, the infant bathing apparatus 100 may come with the frame 102 already assembled with the fixed clip assembly 106 and the one or more straps 120. In addition, the stand 130 may also come with the snap hook assembly 136 fully assembled on the first and second pair of legs 131, 132. The sling 110 (comprising of the body panel 111, the support 112, and the one or more clips 114) and the stand 130 are designed to be removable so that they may be removed after use for easy storage. Specifically referring to the removable parts, the sling 130 is placed into the frame opening 103 and hung from the frame by inserting the one or more clips 114 onto the one or more notches 104 on the frame 102. The stand 130 may be connected to the frame 102 by inserting the first and second pair of legs 131, 132 into the head end 102*a* and the foot end 102*b* of the frame 102, respectively. Specifically, the snap hook assembly 136 on the stand 130 is inserted into the fixed clip assembly 106 on the frame 102.

Figure 8:
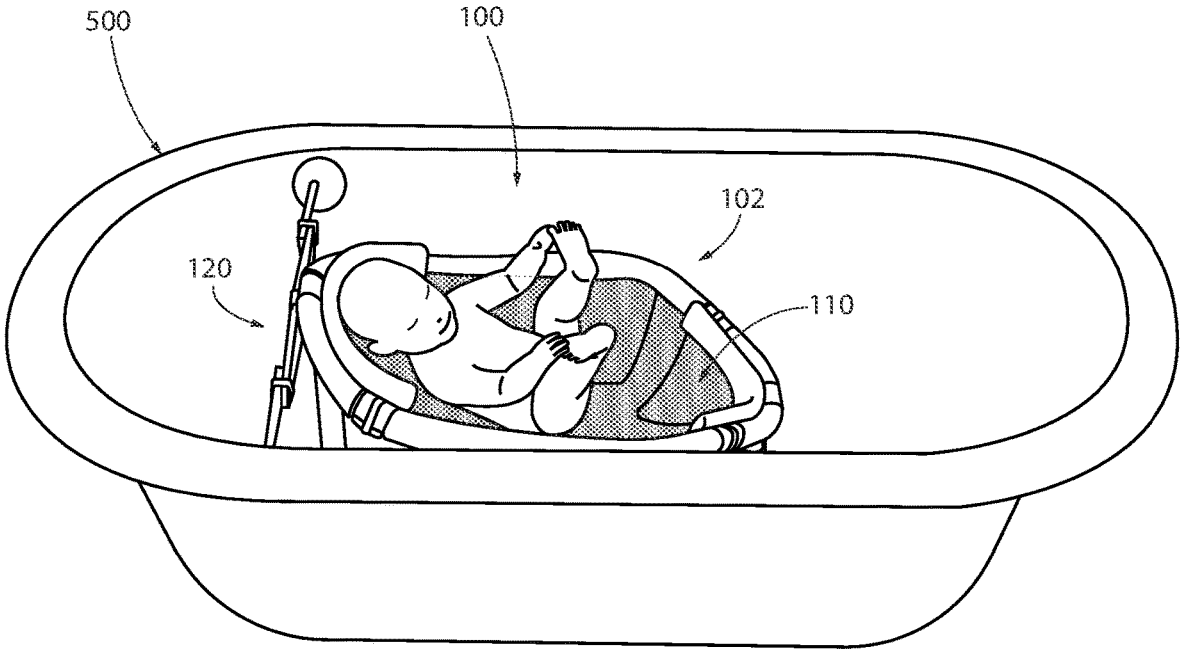
FIG. 8 is a pictorial illustration of a baby nestled within an infant bathing apparatus which is placed within a bathtub.
Figure 9:
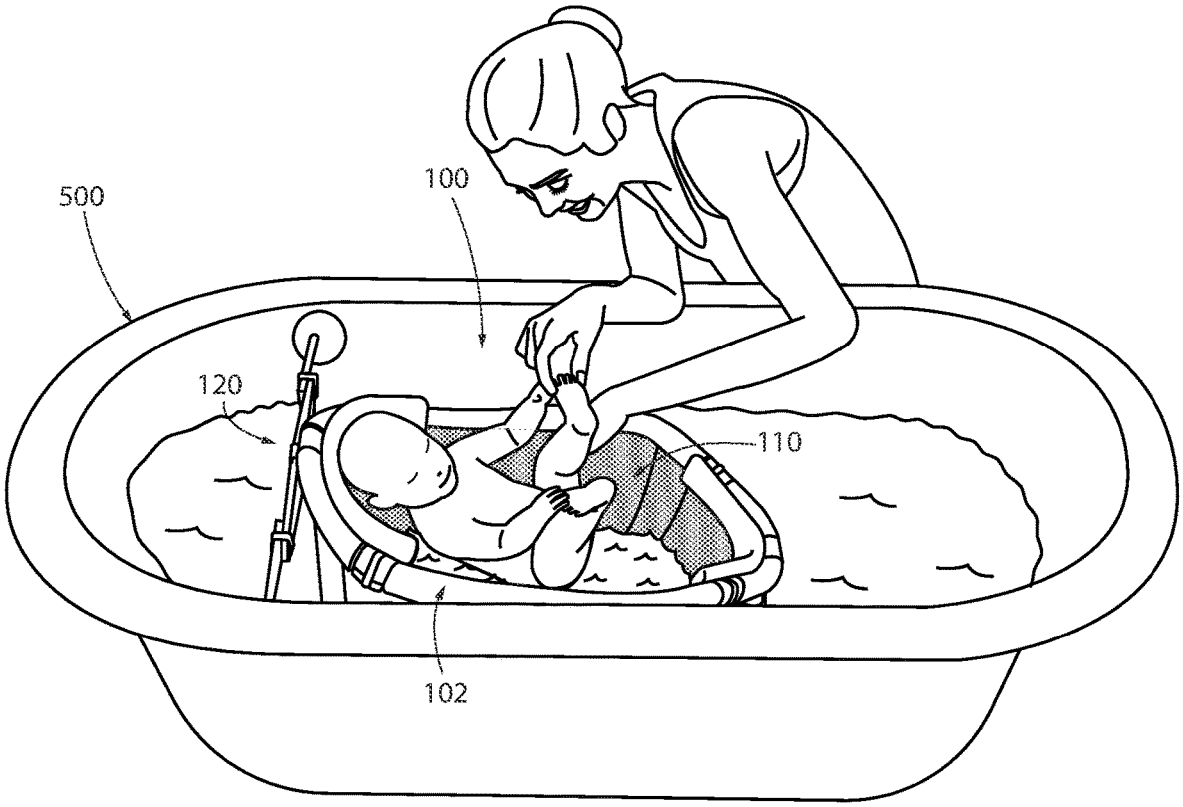
FIG. 9 is a pictorial illustration of a baby nestled within an infant bathing apparatus which is placed within a bathtub filled with water and under a parent's supervision.
Figure 10:
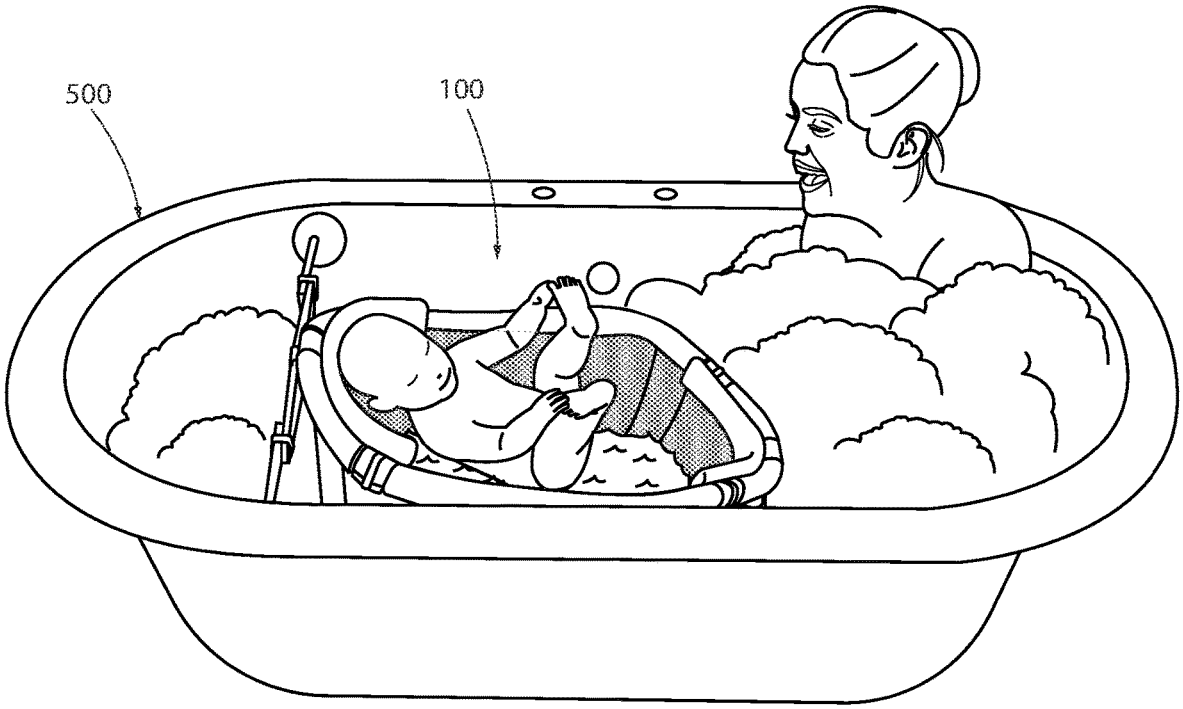
FIG. 10 is a pictorial illustration of a mother and a baby co-bathing in a bathtub with the baby nestled within an infant bathing apparatus which is placed within the bathtub.

FIGS. 7 to 9 illustrate an example use of the infant bathing apparatus 100. In FIG. 7 the infant bathing apparatus 100 is shown set inside the bathtub 500. The infant bathing apparatus 100 may generally be centered inside the bathtub 500 on the stand 130 (see, FIGS. 1-6). The one or more straps 120 may be used to secure the infant bathing apparatus 100 to the sidewalls of the bathtub 500. In the embodiments shown in the Figures, a length of the one or more straps 120 may be adjusted to secure to the sidewall of bathtub 500. The length is adjusted by moving each of the adjustable arms 124 along the stationary arm 122, finding a desired length, and pushing the key nob through the keyhole and pulling to lock into place. Once the adjustable arms 124 are adjusted to the desired length, the suction cups 128 on the ends of the adjustable arms 124 are pressed into the sidewall of the bathtub 500 to secure the infant bathing apparatus 100. The baby may be gently placed in the infant bathing apparatus 100 at this time or after the water has been filled in the bathtub 500 to a desired level. FIG. 8 shows the baby in the infant bathing apparatus 100 before the water is filled to the desired height. The baby is placed gently inside the infant bathing apparatus 100 ensuring that the head is at the highest point of the sling 110 near the head pad 115. FIG. 9 illustrates the baby in the infant bathing apparatus 100 with water filled to a desired height. When the bathtub is starting to fill with water, the water will come through the body panel 111 with the numerous perforations. The parent may bathe the baby while staying outside the tub however under constant supervision, as shown in FIG. 9. The parent may also enter the bathtub 500 and bathe and play with the baby nestled in the infant bathing apparatus 100, as shown in FIG.

10. The parent can sit inside the tube with the stand 130 in place. However, at this time while in the bathtub 500, the parent may remove the stand 130 from the frame 102 and sit fully unhindered in the bathtub 500. The frame 102 will float on the top of the water due to the buoyant material used in the construction of the frame 102. The parent may only remove the second pair of legs 132 or may remove both the first pair of legs 131 and the second pair of legs 132 (see, FIG. 3)

Accordingly, the present description provides for various embodiments for an infant bathing apparatus. Many uses and advantages are offered by the infant bathing apparatus as described above in one or more non-limiting embodiments. The infant bathing apparatus may be relatively portable for easy use and storage and used in various sizes of bathtubs for safe and secure bathing of babies and toddlers in a bathtub. Further, the infant bathing apparatus can be used with the parent sitting unhindered inside the bathtub. The infant bathing apparatus allows the parent and baby to create strong emotional bonds by safely and securely enjoying bath time together.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. An infant bathing apparatus, comprising:

a frame having a rigid structure, the frame defining a frame opening;

a sling configured to be disposed within the frame opening, wherein the sling and the frame are inclined relative to a support surface and adapted to hold a baby in a semi-prone position, wherein the sling comprises a head pad and a foot pad, wherein the head pad and the foot pad are padded portions of the sling corresponding to a head end and a foot end of the frame, wherein the sling is made of a flexible material able to support a baby's weight;

one or more straps connected to the frame and configured to securely connect the frame to a bathtub; and wherein the infant bathing apparatus is sized to be used within varying sizes of bathtubs and used for newborns, infants, and toddlers.

2. The infant bathing apparatus of claim 1, wherein the frame generally has a shape selected from the group consisting of an oval, a circle, and a polygon.

3. The infant bathing apparatus of claim 1, wherein the frame is buoyant such that the frame stays afloat above water with a baby supported in the sling.

4. The infant bathing apparatus of claim 1, wherein the sling comprises of a body panel connected to a support, wherein the body panel is a hammock-like panel and the support is a strip of material strategically connected to the body panel and having means to connect the body panel to the frame.

5. The infant bathing apparatus of claim 4, wherein the means to connect the body panel to the frame includes one or more clips which are integrated to the support, wherein the one or more clips are adapted to clip onto the frame with the sling disposed in the frame opening.

6. The infant bathing apparatus of claim 5, wherein the frame is adapted with one or more notches such that the one or more clips matingly engage with the one or more notches to securely hang the sling within the frame opening, wherein the one or more notches are recessed areas arranged on the frame.

7. The infant bathing apparatus of claim 1, wherein the head pad and foot pad are either integrated to the sling or are removably attachable to the sling.

8. The infant bathing apparatus of claim 1, wherein a body panel of the sling is made of a material that has a multiplicity of perforations through which water may readily circulate.

9. The infant bathing apparatus of claim 1, wherein the one or more straps are adjustable by being extendable and retractable to securely connect to one or more side walls of the varying sized bathtubs, wherein the one or more straps comprise of a suction cup on each end of the one or more straps that extends toward a side wall of the one or more side walls of the bathtub.

10. The infant bathing apparatus of claim 9, wherein the one or more straps comprise of a stationary arm that connects to a head end of the frame, the stationary arm further comprising a plurality of keyholes equally spaced and in line, wherein the one or more straps comprise of two adjustable arms connected to the stationary arm wherein the two adjustable arms each have the suction cup on each end that faces toward the one or more sidewalls of the bathtub and the two adjustable arms further comprising of a key nob on each of the adjustable arms opposite of the suction cup, and wherein the key nob on each of the two adjustable arms engages with the plurality of keyholes on the stationary arm, wherein the two adjustable arms slide along the stationary arm to move to a desired length and pushing the key nob on each of the two adjustable arms into one keyhole of the plurality of keyholes for each key nob to lock into place.

11. The infant bathing apparatus of claim 1, wherein the sling is removable from the frame for washing and storage.

12. An infant bathing apparatus, comprising:

a frame having a rigid structure, the frame defining a frame opening;

a sling configured to be disposed within the frame opening, wherein the sling and the frame are inclined relative to a support surface and adapted to hold a baby in a semi-prone position with, wherein the sling comprises a head pad and a foot pad, wherein the head pad and the foot pad are padded portions of the sling corresponding to a head end and a foot end of the frame, wherein the sling is made of a flexible material able to support a baby's weight;

one or more straps connected to the frame and configured to securely connect the frame to a bathtub;

a stand configured to connect to the frame and adapted to rest on a floor of the bathtub; and wherein the infant bathing apparatus is sized to be used within varying sizes of bathtubs and used for newborns, infants, and toddlers.

13. The infant bathing apparatus of claim 12, wherein the frame is buoyant such that the frame stays afloat above water with a baby supported in the sling.

14. The infant bathing apparatus of claim 12, wherein the sling comprises of a body panel connected to a support, wherein the body panel is a hammock-like panel and the support is a strip of material strategically connected to the body panel and having means to connect the body panel to the frame.

15. The infant bathing apparatus of claim 14, wherein the means to connect the body panel to the frame includes one or more clips which are integrated to the support, wherein the one or more clips are adapted to clip onto the frame with the sling disposed in the frame opening.

16. The infant bathing apparatus of claim 15, wherein the frame is adapted with one or more notches such that the one or more clips matingly engage with the one or more notches to securely hang the sling within the frame opening, wherein the one or more notches are recessed areas arranged on the frame.

17. The infant bathing apparatus of claim 12, wherein the head pad and foot pad are either integrated to the sling or are removably attachable to the sling.

18. The infant bathing apparatus of claim 12, wherein a body panel of the sling is made of a material that has a multiplicity of perforations through which water may readily circulate.

19. The infant bathing apparatus of claim 12, wherein the one or more straps are adjustable by being extendable and retractable to securely connect to one or more side walls of varying sized bathtubs, wherein the one or more straps comprise of a suction cup on each end of the one or more straps that extends toward a side wall of the one or more side walls of the bathtub.

20. The infant bathing apparatus of claim 19, wherein the one or more straps comprise of a stationary arm that connects to a head end of the frame, the stationary arm further comprising a plurality of keyholes equally spaced and in line, wherein the one or more straps comprise of two adjustable arms connected to the stationary arm wherein the two adjustable arms have the suction cup on each end of the one or more straps that faces toward a sidewall of the bathtub and the two adjustable arms further comprising of a key nob on each of the adjustable arms opposite of the suction cup, and wherein the key nob on each of the two adjustable arms engages with the plurality of keyholes on the stationary arm, wherein the two adjustable arms slide along the stationary arm to move to a desired length and pushing the key nob on each of the two adjustable arms into one keyhole of the plurality of keyholes for each key nob to lock into place.

21. The infant bathing apparatus of claim 12, wherein the stand comprises of one or more legs that are connected to a head end of the frame and a foot end of the frame, wherein the frame and the one or more legs are connected to each other by a snap joint assembly wherein the frame includes one or more fixed clip assemblies and the one or more legs may include one or more snap hook assemblies that matingly connect to each other.

22. The infant bathing apparatus of claim 12, wherein the sling is removable from the frame for washing and storage, and wherein the stand is removable from the frame allowing for a parent to sit in the bathtub with a baby supported in the frame on the sling.

* * * * *